US012600009B2

(12) United States Patent
Li et al.

(10) Patent No.: US 12,600,009 B2
(45) Date of Patent: Apr. 14, 2026

(54) GRINDING METHOD USING NANOLAYER-LUBRICATED DIAMOND GRINDING WHEEL BASED ON SHOCK WAVE CAVITATION EFFECT

(71) Applicant: HUNAN INSTITUTE OF SCIENCE AND TECHNOLOGY, Yueyang (CN)

(72) Inventors: Chao Li, Yueyang (CN); Xiaohong Zhang, Yueyang (CN); Zhaoyao Shi, Yueyang (CN); Yuejiao Ding, Yueyang (CN); Liwei Ning, Yueyang (CN); Xiaohong Tang, Yueyang (CN); Songhui Zhang, Yueyang (CN); Wei Li, Yueyang (CN); Wanyi Tian, Yueyang (CN)

(73) Assignee: HUNAN INSTITUTE OF SCIENCE AND TECHNOLOGY, Yueyang (CN)

( * ) Notice: Subject to any disclaimer, the term of this patent is extended or adjusted under 35 U.S.C. 154(b) by 520 days.

(21) Appl. No.: 18/119,297

(22) Filed: Mar. 9, 2023

(65) Prior Publication Data

US 2023/0311272 A1 Oct. 5, 2023

Related U.S. Application Data

(63) Continuation of application No. PCT/CN2021/099803, filed on Sep. 7, 2021.

(30) Foreign Application Priority Data

Sep. 14, 2020 (CN) ..... 202010960728.4

(51) Int. Cl.
*B24B 55/03* (2006.01)
*B24C 5/08* (2006.01)

(52) U.S. Cl.
CPC ..... *B24B 55/03* (2013.01); *B24C 5/08* (2013.01)

(58) Field of Classification Search
CPC ..... B24B 55/03; B24B 55/02; B24B 41/06; B24B 49/00; B24B 49/006; B24B 49/14;
(Continued)

(56) References Cited

U.S. PATENT DOCUMENTS 2,858,652 A * 11/1958 Luthman ..... B24B 53/007 134/1
2018/0354096 A1* 12/2018 Li ..... B24B 55/02

FOREIGN PATENT DOCUMENTS

CN 102212818 A * 10/2011 ..... C23C 4/04
CN 105033780 A 11/2015
(Continued)

OTHER PUBLICATIONS

REN Publication Oct. 12, 2011 retrieved translation from Espacenet: https://worldwide.espacenet.com/patent/search/family/044744342/publication/CN102212818A?q=CN%20102212818%20A (Year: 2011).*

(Continued)

*Primary Examiner* — Monica S Carter
*Assistant Examiner* — Christopher Soto

(57) ABSTRACT

The present invention provides a nanolayer-lubricated diamond grinding wheel grinding method based on a shock wave cavitation effect. In the method, after a gas pressure regulation valve is turned on, a shock wave generated by an acceleration tube pushes nanoparticles to move forward, and the nanoparticles are then accelerated by a small de Laval nozzle to acquire a high initial velocity. One wave source of a shock wave speed-increase module generates a high-frequency high-strength shock wave, to impact nanoparticles with an initial velocity, to enable the nanoparticles to
(Continued)

be continuously accelerated downward in an axial direction of a large de Laval nozzle, until the nanoparticles are embedded on a grinding wheel surface at a maximum speed to form a nanolayer. The other wave source is used to clean impurities on the grinding wheel surface. In a processing process, the nanoparticles of the nanolayer are autonomously released in a core grinding region, to implement self-lubrication and cooling inside the grinding region. This method significantly enhances lubrication and cooling effects and satisfies the green development idea.

10 Claims, 3 Drawing Sheets

(58) Field of Classification Search
CPC ..... B24B 53/007; B24B 53/095; B24B 55/12; B24B 57/04; B24B 53/013; B24C 5/08
See application file for complete search history.

(56) References Cited

FOREIGN PATENT DOCUMENTS

| | | | |
|---|---|---|---|
| CN | 111993270 | A | 11/2020 |
| CN | 112025554 | A | 12/2020 |
| CN | 103231310 | A | 8/2022 |
| EP | 0624426 | | 11/1994 |

OTHER PUBLICATIONS

International Search Report of PCT/CN2021/099803.

* cited by examiner

GRINDING METHOD USING NANOLAYER-LUBRICATED DIAMOND GRINDING WHEEL BASED ON SHOCK WAVE CAVITATION EFFECT

RELATED APPLICATION

The present application claims the priority of PCT application No. PCT/CN2021/116845, titled "METHOD FOR LUBRICATING DIAMOND WHEEL GRINDING WITH SHOCK WAVE CAVITATION EFFECT BASED NANOLAYER" filed on Sep. 7, 2021.

FIELD OF THE INVENTION

The present invention relates to the field of lubrication and cooling technologies in grinding, and in particular, to a nanolayer-lubricated diamond grinding wheel grinding method based on a shock wave cavitation effect.

BACKGROUND

Grinding process is widely used in the current processing industry because of its characteristics such as high machining accuracy and adaptability to workpiece materials. However, energy consumed in grinding to remove a unit volume of material is much higher than that in several other common forms of processing. Nearly 90% of the consumed energy is gathered in a grinding region in the form of grinding heat, leading to a high temperature and a high pressure in the grinding region, which affects the service life of a grinding tool and reduces the surface accuracy of a workpiece.

Conventional pouring lubrication manner uses a method of continuously pouring a large amount of grinding fluid into a grinding region for cooling and lubrication. With the excellent lubrication characteristic of the grinding fluid, the grinding fluid forms an oil film on the surface of a workpiece, thereby reducing a friction coefficient and a grinding force between a grinding wheel and the workpiece. However, a large amount of grinding fluid is required in this lubrication method, which is contrary to the development background of today's environmental protection and low carbon. In addition, the high-speed rotation of the grinding wheel drives the movement of surrounding air, which in turn forms a dense "air barrier layer" around the grinding wheel, making it difficult for grinding fluid ejected from a nozzle to enter a grinding region. The actual effective flow of grinding fluid is only 5% to 40% of the total flow of the nozzle. The grinding fluid cannot enter a contact interface between the grinding wheel and the workpiece, resulting in thermal damage to the surface of the workpiece in a contact area, which in turn affects the accuracy of the workpiece.

Nanoparticles have excellent thermal conductivity due to their properties, and the surface area and heat capacity of nanoparticles are much larger than those of millimeter or micron-sized solid particles under the same volume content. In grinding, the addition of nanoparticles improves the heat exchange performance of a grinding fluid, and nanoparticles play a role of strengthening heat exchange and reducing the temperature of a grinding region. In addition, nanoparticles also have excellent friction reduction and anti-wear properties and high load-bearing capacity, so that the tribological performance of lubricating fluids can be further improved.

Disclosed in the Patent No. CN109759958A titled "Electrostatic Nozzle and Controlled Jet Micro-lubrication Grinding System" are an electrostatic nozzle and a controlled jet micro-lubrication grinding method and device, the principle of which is to design various types of electrostatic nozzles to accelerate the micro injection of grinding coolant containing nanoparticles into a grinding region, thereby improving the cooling and lubrication effects of the grinding region to a certain extent. However, the technical solution still has the following problems. During actual grinding, due to the obstruction of an air barrier layer on a grinding wheel surface and the closed nature of a grinding region, it is currently very difficult to fully and effectively inject droplets containing nanoparticles into a core position of the grinding region, and the problem of instant response lubrication of nanoparticles inside the grinding region cannot be solved.

SUMMARY

An objective of the present invention is to solve the problem that it is difficult for grinding fluid to enter a core grinding region due to the impact of an air barrier layer in a grinding process using a grinding wheel, and contained nanoparticles cannot implement instant response lubrication in the grinding region.

To achieve above objective, the present invention provides a grinding method using a nanolayer-lubricated diamond grinding wheel based on a shock wave cavitation effect, wherein the method includes:

A grinding method using nanolayer-lubricated diamond grinding wheel based on a shock wave cavitation effect, wherein the method includes:

step S1. generating compressed gas and storing the compressed gas in a gas tank;

step S2. inputting the compressed gas into a gas acceleration tube, which has a push plate, a high pressure chamber and a low pressure chamber; inputting nanoparticles into the low pressure chamber and inputting compressed gas into the high pressure chamber, in which the compressed gas is further pressurized by the push plate until pressure of the compressed gas reaches a first preset threshold;

Step S3. Opening the high pressure chamber, so that the compressed gas is delivered to the low pressure chamber with a streamline tightening structure to push the nanoparticles therein to a second wave focusing device;

Step S4. setting two shock wave sources, a first shock wave source and a second shock wave source, which are both facing towards the grind wheel;

step S5. generating shock waves in sequence with the two shock wave sources, wherein the first shock wave source generates shock waves and enhance the shock waves using a first wave focusing device in front of the second shock wave source, and the second shock wave source generates shock waves and brings the nanoparticles in the second wave focusing device to impact the grind wheel;

Step S6. forming a uniformly distributed nanolayer on the grinding wheel surface by using the shock waves.

Preferably, step S1 includes: turning on a gas pump (5) to suck gas after a workpiece (21) is fixed at a workpiece fixing plate (22) of a workbench, wherein the gas is compressed into a gas tank (8) through a gas-guide tube (6), and when a gas pressure detector (7) detects that gas pressure in the gas tank (8) satisfies a first preset requirement, the gas pump (5) is stopped, or else, the gas pump (5) goes on working; and after the gas pump (5) and the gas tank (8) start to work, turning on a powder delivery switch (40), so that nanoparticles (11) stored in a detachable sealed powder delivery box (39) is delivered into a low-pressure chamber (31);

Preferably, step S2 includes: turning on a gas pressure regulation valve (9), so that the compressed gas in the gas tank (8) enters a movable chamber (35) in an acceleration tube (10) through a gas inlet tube (36), to push a push plate (34) to compress a gas in a high-pressure chamber (33); and turning on a gas pressure sensing switch (32) after sensing that a gas pressure of the high-pressure chamber (33) satisfies a second preset requirement, so that the compressed gas in the high-pressure chamber (33) enters the low-pressure chamber (31) to generate a shock wave;

Preferably, step S3 includes: turning on a movable switch (30) so that the generated shock wave passes through a streamlined narrowing structure of the low-pressure chamber (31) to form a pulse enhanced shock wave to push the nanoparticles to move forward, and then the nanoparticles is further accelerated by a small de Laval nozzle (29), so that the nanoparticles acquire an initial velocity;

Preferably, step S4 includes: connecting an electromagnetic coil (13) to a bipolar high-pressure pulse current to enable the electromagnetic coil to generate a bidirectional electromagnetic force, to push an impact ball (16) to start to reciprocate in a semicircular annular pipe, and to strike back and forth on the impact heads (12) at two ends of the semicircular annular pipe at a high speed to both generate high-frequency ballistic shock waves, wherein strength of the shock waves is then improved under the action of a wave focusing device (18); and when the impact ball (16) strikes the impact heads (12) at two ends of the semicircular annular pipe back and forth, a heat sink (14) starts to operate;

Preferably, step S5 includes: generating shock wave continually, wherein a former shock wave directly impacts a grinding wheel surface to generate a cavitation effect to clean impurities on the grinding wheel surface, and also provides a condition for subsequent formation of a nanolayer; a next shock wave impacts the nanoparticles with a high initial velocity, to provide the nanoparticles with a higher speed; and subsequent shock waves continuously increase speed of the nanoparticles, so that the nanoparticles are continuously accelerated downward in an axial direction of the large de Laval nozzle (19) by using a Laval effect of a large de Laval nozzle (19), until the nanoparticles impact the grinding wheel surface at a maximum speed; and Preferably, step S6 includes: eventually forming a uniformly distributed nanolayer (41) on the grinding wheel surface by using the continuous accelerated of shock waves, which inducing that the nanoparticles (11) undergo a process of embedding, deposition, and film forming in a bronze binder layer (43) of the grinding wheel surface.

Preferably, the grinding method uses a diamond grinding wheel with a metal binder layer thereon, wherein the metal binder is a bronze binder and the nanoparticles (11) are metal nanoparticles.

Preferably, the metal nanoparticles include ferric oxide magnetic nanoparticles, with sizes ranging from 50 nm to 100 nm.

Preferably, the compressed gas in the gas tank (8) is air, and the first preset threshold ranges from 2.0 MPa to 8.0 MPa; and the structure of the acceleration tube (10) in the acceleration module is of a streamlined narrowing type to enhance the generated shock wave, and a gas flow rate of the acceleration tube (10) ranges from 320 m/s to 1200 m/s, to ensure that the nanoparticles acquire the high initial velocity. Preferably the second preset threshold is higher than the first preset threshold.

Preferably, the method includes: generating bidirectional electromagnetic force by using the electromagnetic coil (13) externally connected to the bipolar high-pressure pulse current, to push the impact ball (16) to strike the impact heads (12) at two ends back and forth of the semicircular annular pipe, to both generate two high-frequency ballistic shock wave sources.

Preferably, the method includes: based on different positions of the wave focusing device (18), using one of the high-frequency ballistic shock wave source undergoes convergence to form a low-strength high-frequency shock wave, to directly impact the grinding wheel surface to generate a cavitation effect to clean the impurities on the grinding wheel surface, and the other high-frequency ballistic shock wave source forms a high-strength high-frequency shock wave, to continuously increase the speed of the nanoparticles, until the nanoparticles impact the grinding wheel surface at a final speed ranging from 4200 m/s to 6800 m/s to form the nanolayer (41), wherein the thickness of the nanolayer (41) ranges from 5 μm to 15 μm.

The technical effects of the present invention are as follows:

1. In the method of the present invention, nanoparticles are directly uniformly embedded on a grinding wheel surface through a shock wave to form a nanolayer, which is equivalent to that nanoparticles are released from inside a grinding wheel to a processing surface of a workpiece, thereby greatly improving the lubrication and cooling effects of a core grinding region, significantly reducing specific grinding energy, at the same time reducing the wasteful use of a large amount of grinding fluid, and satisfying an energy conservation and environmental protection requirement promoted in the industrial field. A recycling module can recycle nanoparticles that are not embedded in the grinding wheel surface and nanoparticles that are released after grinding.

2. In the present invention, an impact ball strikes impact heads on the left and right to form two shock wave sources. One of the shock wave sources pushes nanoparticles to accelerate and impact the grinding wheel surface, and the other shock wave source is used to clean impurities such as debris on the grinding wheel surface, thereby reducing the impact of the debris on grinding performance, and at the same time providing an advantage environment for subsequent formation of a nanolayer.

3. After treatment using the method of the present invention, the grinding wheel surface has smaller deformation, would not cause defects such as corrosion and fracture in the grinding wheel surface, would not carbonize diamond abrasive particles, and would not change the structure and use of the grinding wheel.

4. This method has high efficiency and a fast formation speed of a nanolayer, so that automation can be implemented, the cost is low, and an industrial production requirement is satisfied.

5. When energy of a shock wave is transferred inward, the structure of the grinding wheel surface is changed, causing initial refinement of coarse grains of a grinding wheel binder, so that an advantage condition is provided for improving the binding performance between the grinding wheel surface and the nanolayer, and causes no impact to the formed nanolayer.

6. Based on the initial refinement of a high-frequency low-strength shock wave, a high-frequency high-strength shock wave further refines the grains of the grinding wheel binder, causing the grains of the grinding wheel binder to eventually turn from micron and submicron-sized grains into nano-sized grains, thereby enhancing the binding degree between the nanoparticles and the grinding wheel surface.

7. Under the action of modification by the impact of the high-frequency low-strength shock wave, the binding performance of the subsequently formed nanolayer is significantly improved, so that in a rotation process of the grinding wheel, the nanolayer is kept from falling off in large pieces from the grinding wheel surface, and the overall peeling of the nanolayer becomes impossible. A deposited nanolayer autonomously supplies released nanoparticle only under the action of intense mechanical rubbing, collision, and extrusion in a grinding arc region.

8. In the present invention, in an acceleration tube, when a gas pressure sensing on-off valve is turned on, a high-pressure chamber gas flows into a low-pressure chamber. Further, with a streamlined narrowing-type structural design of the acceleration tube, an enhanced shock wave that moves at a speed exceeding the sonic speed is generated. A gas flow under the shock wave also moves at a high speed. The movement of the gas flow enables nanoparticles to acquire a high initial velocity, and then the nanoparticles are accelerated by a small de Laval nozzle and ejected. At the same time, under the action of a bidirectional electromagnetic force, the impact ball continuously and reciprocally strikes the impact heads to generate high-frequency shock waves, which are converged by a wave focusing device to form high-strength shock waves. The high-frequency high-strength shock waves generate a strong pushing force for the nanoparticles, to make the nanoparticles move downward at a speed several times the sonic speed. As the shock waves continuously propagate in air, the nanoparticles are continuously accelerated. In addition, due to the impact of a de Laval effect, the speed of the nanoparticles keeps increasing, so that the nanoparticles impact the grinding wheel surface at a maximum speed, and are embedded in the grinding wheel surface to form a nanolayer. When the nanolayer is in contact with a workpiece to be ground, nanoparticles are autonomously released in the grinding region, to implement switching of a lubrication manner of a grinding region from the outside to the inside. Nanoparticles that fall off are recycled by the recycling module.

DRAWING MARKERS

Figure 1:
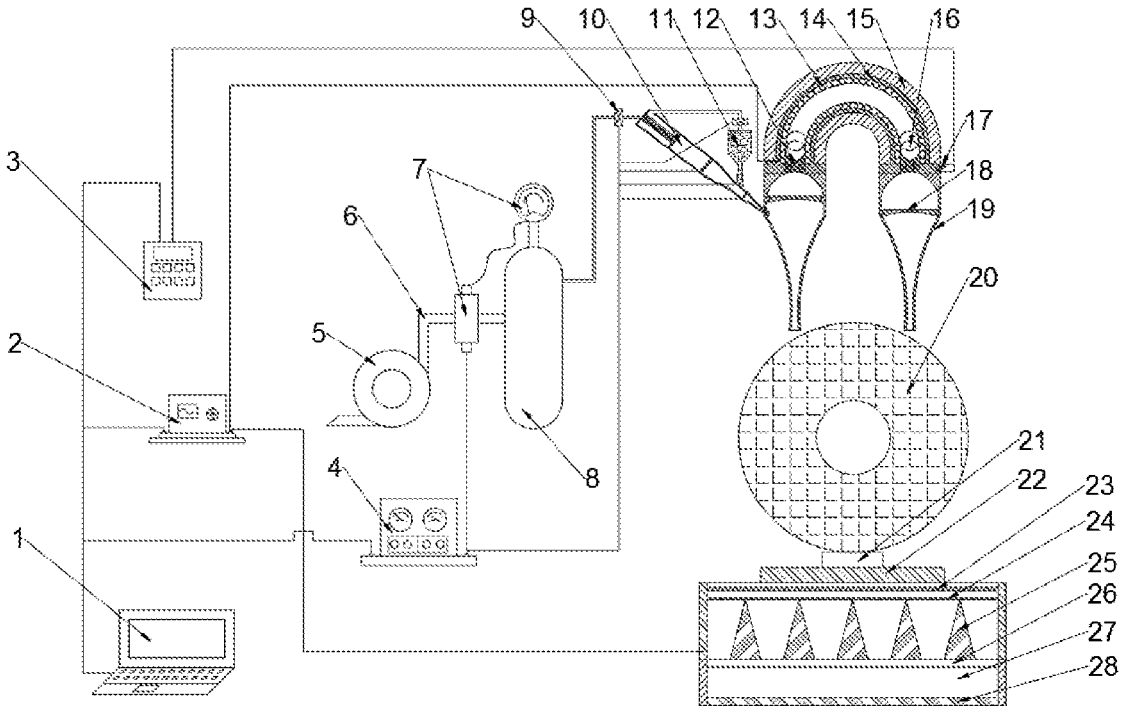
FIG. 1 is a schematic diagram of a nanolayer-lubricated diamond grinding wheel grinding apparatus based on a shock wave cavitation effect.
Figure 2:
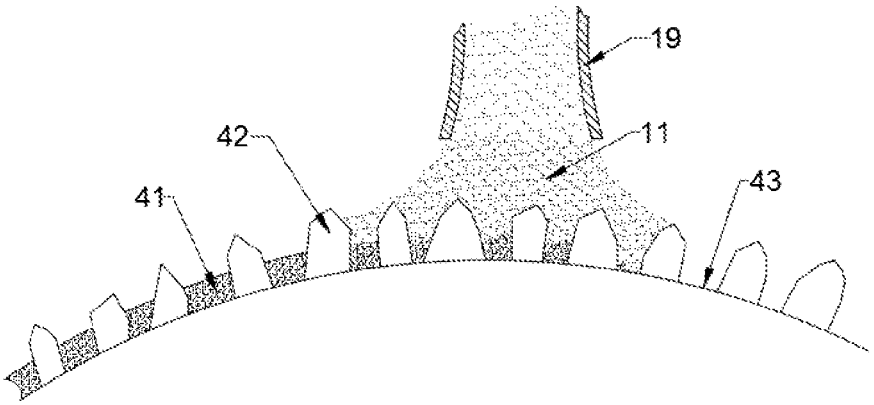
FIG. 2 is a schematic diagram of the principle of nanoparticles forming a nanolayer on a grinding wheel surface.
Figure 3:
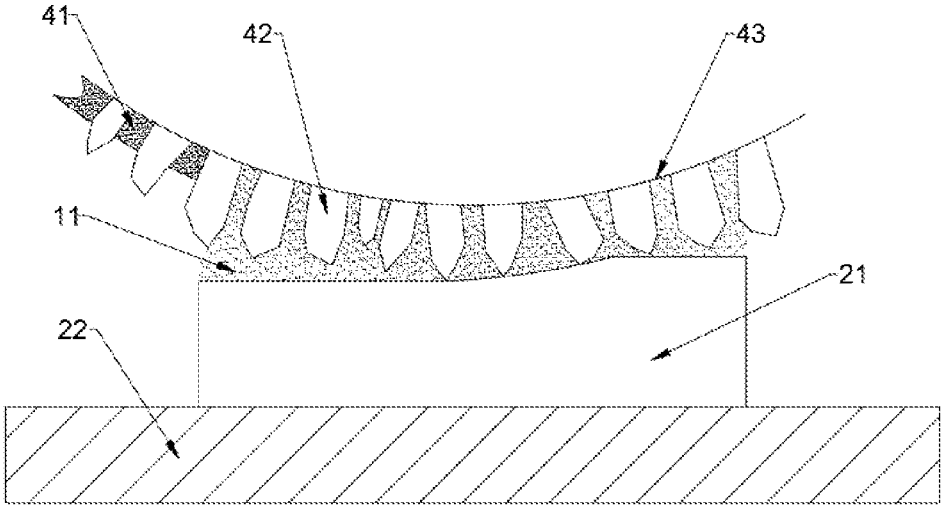
FIG. 3 is a schematic diagram of the principle of a nanolayer releasing nanoparticles inside a grinding region.

1. operation main controller,
2. current controller,
3. temperature controller,
4. pressure controller,
5. gas pump,
6. gas-guide tube,
7. gas pressure detector,
8. gas tank,
9. gas pressure regulation valve,
10. acceleration tube,
11. nanoparticle,
12. impact head,
13. electromagnetic coil,
14. heat sink,
15. ceramic insulator,
16. impact ball,
17. temperature sensor,
18. wave focusing device,
19. large de Laval nozzle,
20. grinding wheel,
21. workpiece,
22. workpiece fixing plate,
23. coarse vibration filtering mesh film,
24. fine vibration filtering mesh film,
25. electromagnetic block,
26. recycling box cover,
27. recycling box,
28. external magnetic field,
29. small de Laval nozzle,
30. movable switch,
31. low-pressure chamber,
32. gas pressure sensing switch,
33. high-pressure chamber,
34. push plate,
35. movable chamber,
36. gas inlet tube, 37. spring,
38. gas flow valve,
39. detachable sealed powder delivery box,
40. powder delivery switch,
41. nanolayer,
42. diamond abrasive particle
43. grinding wheel bronze binder layer.

DETAILED DESCRIPTION OF EMBODIMENTS

To enable a person skilled in the art to better understand the solutions of the present invention, the technical solutions of the embodiments of the present invention will be described below clearly and comprehensively in conjunction with the drawings of the embodiments of the present invention. Clearly, the embodiments described are merely some embodiments of the present invention and are not all the possible embodiments. Based on the embodiments of the present invention, all other embodiments obtained by those of ordinary skill in the art fall in the protection scope of the present invention.

As shown in FIG. 1 to FIG. 5, this embodiment provides a nanolayer-lubricated diamond grinding wheel grinding apparatus based on a shock wave cavitation effect. The essence of the apparatus is to use a shock wave generated from the impact of an impact ball 16 to accelerate nanoparticles to enable the nanoparticles to form a nanolayer 41 on a metal binder layer 43 on a grinding wheel surface. When the nanolayer 41 rotates to be in contact with a workpiece 21, nanoparticles are released to achieve lubrication and cooling inside a grinding region, to implement switching of a grinding lubrication manner from the outside to the inside, thereby improving grinding quality. In addition, the present invention also provides a method for cleaning impurities such as debris on a grinding wheel surface by using a shock wave and recycling nanoparticles, thereby reducing the cost and improving grinding quality.

The apparatus includes a control system, an acceleration module, a shock wave speed-increase module, a processing module, and a recycling module. The control system includes an operation main controller 1, a current controller 2, a temperature controller 3, and a pressure controller 4. The acceleration module includes a gas pump 5, a gas-guide tube 6, a gas pressure detector 7, a gas tank 8, a gas pressure regulation valve 9, an acceleration tube 10, a small de Laval nozzle 29, a movable switch 30, a gas pressure sensing switch 32, a push plate 34, a gas inlet tube 36, a spring 37, a gas flow valve 38, a detachable sealed powder delivery box 39, and a powder delivery switch 40. The shock wave speed-increase module includes an impact head 12, an electromagnetic coil 13, a heat sink 14, a ceramic insulator 15, the impact ball 16, a temperature sensor 17, a wave focusing device 18, and a large de Laval nozzle 19. The processing module includes a grinding wheel 20, the workpiece 21, and a workpiece fixing plate 22. The recycling module includes a coarse vibration filtering mesh film 23, a fine vibration filtering mesh film 24, an electromagnetic block 25, a recycling box 27, and an external magnetic field 28.

The control system is connected to and controls the acceleration module, the shock wave speed-increase module, and the recycling module. Specifically, the operation main controller 1 is connected to and controls the current controller 2, the temperature controller 3, and the pressure controller 4. The current controller 2 is connected to the electromagnetic coil 13 and the electromagnetic block 25, and controls generation of magnetic fields thereof through energization. The temperature controller 3 is connected to the heat sink 14 and the temperature sensor 17, detects a temperature through the temperature sensor 17, and then controls an operating frequency of the heat sink 14. The pressure controller 4 is connected to the gas pressure detector 7. After detecting through the gas pressure detector 7 that a gas pressure in the gas tank 8 satisfies a requirement, the pressure controller 4 controls the gas pressure regulation valve 9, the gas pressure sensing switch 32, the gas flow valve 38, the powder delivery switch 40, and the movable switch to be turned on or off to control gas pressures for chambers. The control system is used to control the operation of the entire apparatus, to implement the automation of this apparatus.

Figure 4:
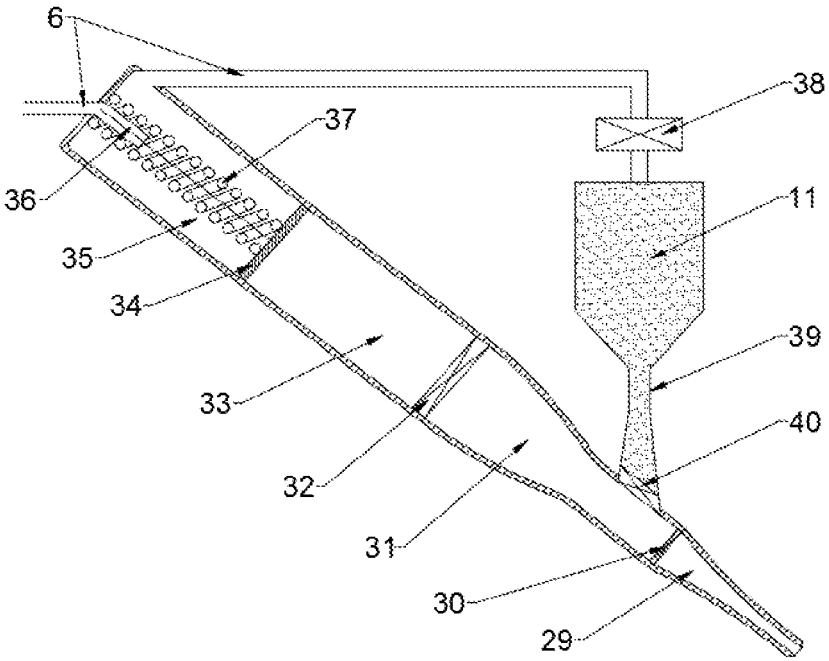
FIG. 4 is a partial structural diagram of an acceleration module.

As shown in FIG. 4, in the acceleration module, the gas pump 5 and the gas tank 8 and the gas tank 8 and the acceleration tube 10 are connected by the gas-guide tube 6 for gas communication. A gas pressure detector 7 is installed at each of the gas-guide tube 6 between the gas pump 5 and the gas tank 8 and the gas tank 8. A gas pressure regulation valve 9 is installed at the gas-guide tube 6 between the gas tank 8 and the acceleration tube 10. The gas pump 5 and the gas tank 8 may be a high-pressure gas source, and is used to provide a compressed gas. The acceleration tube 10 is separated into a movable chamber 35, a high-pressure chamber 33, and a low-pressure chamber 31. The movable chamber 35 and the high-pressure chamber 33 are separated by the movable push plate 34. The high-pressure chamber 33 and the low-pressure chamber 31 are separated by the gas pressure sensing switch 32. The low-pressure chamber 31 and the small de Laval nozzle 29 are separated by the movable switch 30. An upper end of a tail of the low-pressure chamber 31 is connected to the detachable sealed powder delivery box 39 in a sealed manner. The powder delivery switch 40 is installed at the connecting position. The small de Laval nozzle 29 and the acceleration tube 10 are connected in a flange-sealed manner, and tube openings at the connecting position between the two tubes have a consistent diameter. An upper end of the detachable sealed powder delivery box 39 is connected to the movable chamber 35 in the acceleration tube 10 through the gas-guide tube 6, and the gas flow valve 38 is installed on the gas-guide tube 6. A powder delivery pipe at a lower end of the detachable sealed powder delivery box is of a Venturi tube structure, which is advantage to the accelerated falling of nanoparticles 11, and blockage does not occur easily after long-term use. The gas pressure regulation valve 9, the gas pressure sensing switch 32, the gas flow valve 38, the powder delivery switch 40, and the movable switch 30 are connected to the pressure controller 4, and are turned on or off in a certain sequence to generate a required shock wave.

When the gas pressure sensing switch 32 between the high-pressure chamber 33 and the low-pressure chamber 31 in the acceleration tube 10 is turned on, a shock wave is generated based on the principle of shock wave dynamics theories. In a case of actual flowing that satisfies a strong shock wave Mach number, the structure at the low-pressure chamber 31 in the acceleration tube 10 is of a streamlined narrowing type, which achieves the enhancement of a shock wave, thereby ensuring that the nanoparticles acquire a high initial velocity. A specific process of forming an enhanced shock wave is as follows. In the beginning, a planar strong compression wave is generated in the high-pressure chamber 33; since a cross-sectional area in the low-pressure chamber 31 first decreases quickly and then decreases slowly, the planar strong compression wave is slowly narrowed and enhanced, and that is, a planar shock wave is compressed. The planar strong compression wave is turned into a high-strength curved-surface strong compression wave. When the curved-surface strong compression wave reaches the smallest cross-sectional area, the high-strength curved-surface strong compression wave is slowly expanded and diverged, and the curvature of a wave surface gradually decreases, and eventually the wave is turned into a high-strength planar strong compression wave. Due to the continuity of wave propagating, eventually all strong compression waves are turned into high-strength planar strong compression waves, that is, an enhanced shock wave is formed. The streamlined narrowing type design of the acceleration tube 10 can accurately and efficiently increase the strength of the initial planar strong compression wave, and there is no obvious disturbance in the increase, so that the performance of shock wave propagation can be significantly improved.

Within an elastic limitation, by using the deformation of the spring 37 in combination with turning on or off the gas pressure regulation valve 9, the gas pressure sensing switch 32, the gas flow valve 38, the powder delivery switch 40, and the movable switch 30 in a certain sequence, a pulse shock wave is generated in the acceleration tube 10, to push the nanoparticles at a high frequency to accelerate and move forward. To implement repeated generation and controllability of a shock wave in the acceleration tube 10 and ensure the sustainability of the acceleration of nanoparticles, it is mainly to control as required the generation and release of a compressed gas in the high-pressure chamber 33. The on-off valves are turned on or off according to certain intervals and in sequential cycles. A specific cycle is as follows:

In a first step, the powder delivery switch 40 is turned on. In a second step, the gas flow valve 38 is turned off. In a third step, the gas pressure regulation valve 9 is turned on. In a fourth step, the powder delivery switch 40 is turned off. In a fifth step, the movable switch 30 is turned on. In a sixth step, the gas pressure sensing switch 32 is turned on. In a seventh step, the gas pressure regulation valve 9 is turned off. In an eighth step, the gas pressure sensing switch 32 is turned off. In a ninth step, the movable switch 30 is turned off. In a tenth step, the gas flow valve 38 is turned on. In an eleventh step, the powder delivery switch 40 is turned on.

The nanoparticles in the acceleration chamber 10 acquire an initial velocity under the action of a pulse enhanced shock wave, and are then accelerated under a Laval effect of the small de Laval nozzle 29. When leaving the small de Laval nozzle 29 to enter the large de Laval nozzle 19, the nanoparticles have acquired a high initial velocity. The small de Laval nozzle 29 in the acceleration module is welded on the large de Laval nozzle 19 in the shock wave speed-increase module.

Figure 5:
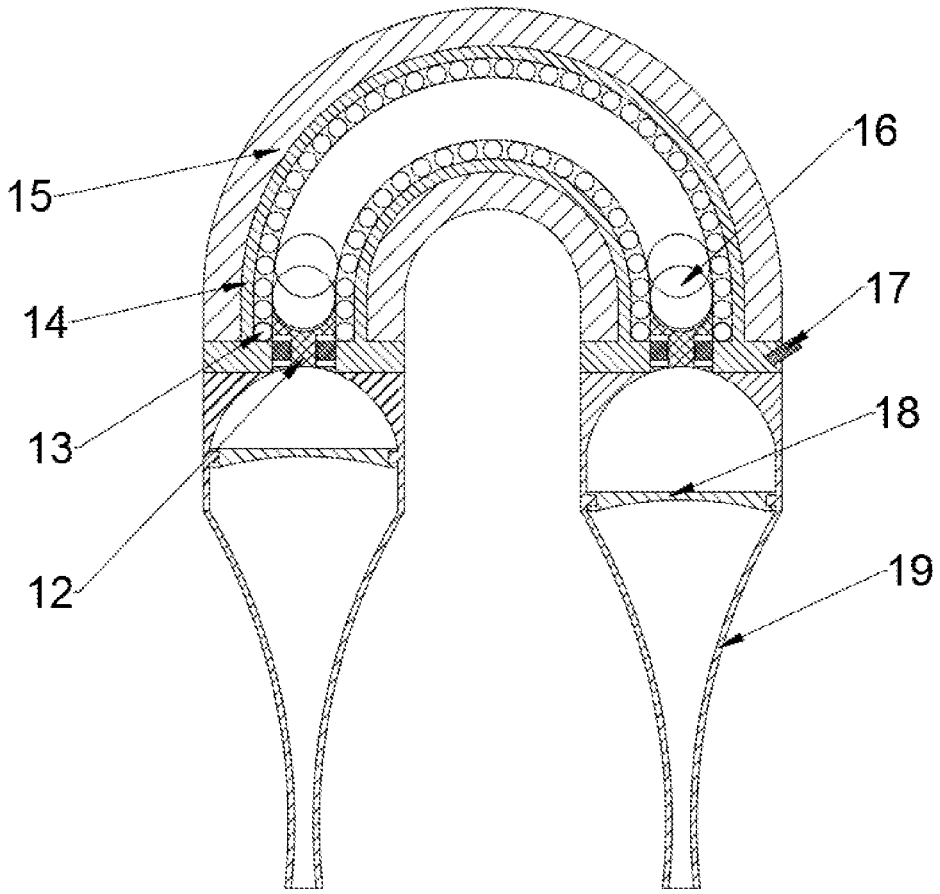
FIG. 5 is a structural diagram of a shock wave speed-increase module.

As shown in FIG. 5, in the shock wave speed-increase module, the electromagnetic coil 13 distributed around the outside of a semicircular annular pipes is connected to a bipolar high-pressure pulse current, to generate a bidirectional electromagnetic force to push the impact ball 16 to move back and forth in the foregoing pipe to strike the impact head 12 to generate two high-frequency ballistic shock waves. The heat sink 14 is distributed at a periphery of the electromagnetic coil 13 and the impact head 12, and is used to dissipate heat generated by the impact ball 16 moving back and forth and striking the impact head 12. The temperature sensor 17 is installed on the heat sink 14. The temperature sensor 17 is connected to the temperature controller 3. When the temperature rises excessively, the temperature controller 3 sends an instruction to increase the operating frequency of the heat sink 14. As the impact ball 16 reciprocates at a high speed in the semicircular annular pipe, the temperature of the pipe keeps rising. After the impact ball 16 strikes the impact head 12, a large amount of heat is also generated around the impact head 12. Thus, the material of the foregoing pipe preferably adopts a material with good temperature reduction and heat dissipation performance. The wave focusing device 18 is located right below the impact head 12, and a coating of an acoustic reflection characteristic material is attached on a wall of the large de Laval nozzle 19 between the two impact head 12, and is used to converge shock waves and increase the impact strength of the shock waves.

The shock speed-increase module forms two shock wave sources. Due to different position arrangements of two wave focusing device 18 in the two large de Laval nozzle 19, after convergence, one of the shock wave sources forms a high-frequency low-strength shock wave, which impacts the grinding wheel surface to generate a cavitation effect, and is used to clean impurities such as debris on the grinding wheel surface, and also provides an advantage condition for the formation of a nanolayer by the nanoparticles on the grinding wheel surface. After convergence, the other shock wave source forms a high-frequency high-strength shock wave, which is used to accelerate impact to the nanoparticles, until the nanoparticles impact the grinding wheel surface at a maximum speed to form the nanolayer 41. The high-strength high-frequency shock wave generates a cavitation effect when impacting the nanoparticles, and has sufficient energy to break through nanoparticles that agglomerate, thereby efficiently inhibiting the agglomeration of the nanoparticles, and improving the dispersion performance of the nanoparticles.

A specific representation of the foregoing cavitation effect is that when a shock wave propagates in the large de Laval nozzle 19, the shock wave has certain acoustic characteristics. Due to differences in acoustic resistance, nanoparticle agglomerates cause different tensions and pressures at different interfaces. Therefore, mechanical breakage occurs inside the nanoparticle agglomerates under the action of tension and pressure differences, which directly releases adhesion in the nanoparticle agglomerates, so that the dispersion performance of the nanoparticles can be efficiently improved. In addition, because a series of cavitation bubbles are generated when a shock wave propagates in the large de Laval nozzle 19, the cavitation bubbles undergo a "merging-growing-shaking-bursting" process. When large cavitation bubbles burst, a large amount of energy can be released, to achieve the objective of further dispersing the nanoparticles.

When the high-frequency shock wave impacts the grinding wheel surface, the shock wave propagates inside the grinding wheel surface from the surface to the interior, and is reflected, transmitted, and disturbed at interfaces such as a grain boundary and phase boundary inside the grinding wheel surface, causing high-strain rate, repeated plastic deformation in the grinding wheel binder layer 43 to form a large number of dislocation, twin crystal or subgrain structures. In addition, the dynamic response of the grinding wheel surface to the shock wave is also completed within a short time, so that grains in the grinding wheel surface are instantly dynamically refined, and eventually the surface layer of the grinding wheel surface forms a gradient structure-refined structure layer. When the nanoparticles impact the grinding wheel surface, the nanoparticles are bound to and deposited on the refined structure layer of the grinding wheel surface to form a layer. In the present invention, two shock waves are used to successively impact the grinding wheel surface, to accelerate the surface layer of the grinding wheel surface to form nano-sized grains, thereby providing an advantage condition for external nanoparticles to form a nanolayer on the grinding wheel surface. A specific process is as follows: A first (former) high-frequency shock wave impacts the grinding wheel surface at a high speed to cause high-strain rate dynamic response at the surface layer of the grinding wheel surface, to generate a plastic deformation. The initial micron coarse grain structure of the grinding wheel surface changes into deformed grains, and at the same time some deformed grains are turned into submicron grains. When the next high-frequency shock wave impacts the nanoparticles to the grinding wheel surface, plastic deformation occurs again in the grinding wheel surface, to implement the accumulation of intense plastic deformation in the grinding wheel surface, so that the deformed grains on the surface and some submicron grains are all converted into nano-sized grains, and eventually the sizes of the grains on the surface are refined to less than 100 nm. Under the high-speed high-pressure impact of the high-strength shock wave and the high adsorbability of the nanoparticles, nanoparticles ejected by the large de Laval nozzle 19 and the refined nano-sized grains on the grinding wheel surface are bound, and there is no obvious boundary between the nanoparticles and the grinding wheel surface. As the nanoparticles that move downward at a supersonic speed continuously impact the grinding wheel surface for binding, deposition, and film forming, the uniformly distributed nanolayer 41 is formed on the grinding wheel surface.

The former shock wave impacts the grinding wheel surface to generate a cavitation effect to clean impurities such as debris on the grinding wheel surface, and at the same time when energy of the shock wave is transferred inward, the structure of the grinding wheel surface is changed, causing initial refinement of coarse grains on the grinding wheel surface. The former shock wave reduces energy required for the next shock wave to refine grains on the grinding wheel surface, so that the second (next) shock wave has sufficient energy to accelerate and impact the nanoparticles to be bound to nano-sized grains on the grinding wheel surface, thereby improving a binding degree. Under the action of modification by the impact of the former shock wave, the binding performance of the subsequently formed nanolayer is significantly improved, so that in a rotation process of the grinding wheel, the nanolayer is kept from falling off in large pieces from the grinding wheel surface, and the overall peeling of the nanolayer becomes impossible. A deposited nanolayer autonomously supplies released nanoparticle only under the action of intense mechanical rubbing, collision, and extrusion in a grinding arc region.

Although the shock waves cause repeated plastic deformation in the grinding wheel surface, the overall structure of the grinding wheel remains unchanged, and only gradient structures are generated in the surface layer, which can refine the structural layer of the grinding wheel surface. After refinement, the structure layer of the grinding wheel surface enhances a binding degree between the binder and diamond abrasive particles 42, thereby reducing a fall rate of abrasive particles in grinding operation, improving the processing efficiency and the surface quality of a workpiece, and also improving the overall service performance of the grinding wheel.

The recycling module is disposed below the workpiece fixing plate 22, and is used to recycle the nanoparticles. The coarse vibration filtering mesh film 23 filters out particles with sizes larger than 1 μm. The fine vibration filtering mesh film 24 filters out particles with sizes smaller than or equal to 100 nm. In an inclined flow channel, under the impact of the electromagnetic block 25, magnetic nanoparticles are adsorbed on a wall of the flow channel. When operation ends and the electromagnetic block 25 are powered off, an automatic switch controls a recycling box cover 26 to be opened. Without the impact of the electromagnetic block 25 and the external magnetic field 28 at the bottom of the box, magnetic nanoparticles on the wall of the flow channel freely fall into the recycling box 27.

An automatic switch is installed on the recycling box 27, and is used to control the recycling box cover 26 to be opened or closed. The automatic switch is connected to the foregoing electromagnetic block 25. The cover is closed when the electromagnetic block is energized to operate, and is opened when the electromagnetic block is powered off.

This embodiment further provides a nanolayer-lubricated diamond grinding wheel grinding method based on a shock wave cavitation effect, which method is described in combination with the apparatus in FIGS. 1-5. Specifically steps of the method are as follows:

Step 1. after a workpiece 21 is fixed at a workpiece fixing plate 22 of a workbench, a gas pump 5 is turned on to suck a gas, the gas is compressed into a gas tank 8 through a gas-guide tube 6, and when a gas pressure detector 7 detects that a gas pressure in the gas tank 8 satisfies a requirement, the gas pump 5 stops operating, or otherwise is turned on; and after the gas pump 5 and the gas tank 8 start to operate, a powder delivery switch 40 is turned on, and nanoparticles 11 stored in a detachable sealed powder delivery box 39 enter a low-pressure chamber 31, to prepare the nanoparticles for acceleration by pushing of a shock wave;

Step 2. a gas pressure regulation valve 9 is turned on, and the compressed gas in the gas tank 8 enters a movable chamber 35 in an acceleration tube 10 through a gas inlet tube 36, to push a push plate 34 to compress a gas in a high-pressure chamber 33; and a gas pressure sensing switch 32 is turned on after sensing that a gas pressure of the high-pressure chamber 33 satisfies a set requirement, and based on the shock wave dynamics theories, the compressed gas in the high-pressure chamber 33 enters the low-pressure chamber 31 to generate a shock wave;

Step 3. a movable switch 30 is turned on, and through a streamlined narrowing structural design of the low-pressure chamber 31 and a spring 37 in combination with the opening or closing of the on-off valves, the generated shock wave forms a pulse enhanced shock wave to push the nanoparticles to move forward, and then is further accelerated by a small de Laval nozzle 29, so that the nanoparticles acquire a high initial velocity;

Step 4. synchronously with step 1, an electromagnetic coil 13 is connected to a bipolar high-pressure pulse current to enable the electromagnetic coil to generate a bidirectional electromagnetic force, to push an impact ball 16 to start to reciprocate in a semicircular annular pipe, impact heads 12 at two ends are struck back and forth at a high speed to form two high-frequency ballistic shock wave sources, one at each end, and then strength of the shock waves is improved under the action of a wave focusing device 18; and when the impact ball 16 strikes the impact heads 12 at two ends back and forth, a heat sink 14 starts to operate;

Step 5. shock waves generated by a former shock wave source directly impact a grinding wheel surface to generate a cavitation effect to clean impurities on the grinding wheel surface, and also provides a condition for subsequent formation of a nanolayer; and shock waves generated by a next shock wave source impacts the nanoparticles with a high initial velocity, to provide the nanoparticles with a higher speed, subsequent shock waves continuously increase speed of the nanoparticles, and the nanoparticles are continuously accelerated downward in an axial direction of the large de Laval nozzle 19 due to a Laval effect of a large de Laval nozzle 19, until the nanoparticles impact the grinding wheel surface at a maximum speed; and Step 6. under continuous acceleration of shock waves, the nanoparticles 11 undergo embedding, deposition, and film forming in a bronze binder layer 43 of the grinding wheel surface, to eventually form a uniformly distributed nanolayer 41.

When the grinding wheel surface with the nanolayer 41 rotates to be in contact with the workpiece 21, inside a core grinding region, due to mechanical actions such as rubbing, collision, and extrusion in grinding, the nanoparticles 11 of the nanolayer 41 are released to form a film. The nanoparticles play a "ball" effect on the interface of the diamond abrasive particles 42/the workpiece 21, to change sliding friction in the grinding region into sliding-rolling complex friction, to implement the lubrication for instantly reducing friction in the grinding region. Further, because the nanoparticles have a good coefficient of heat conducting, the temperature in the grinding region can be efficiently reduced, thereby improving the cooling effect inside the grinding region.

The invention claimed is:

1. A grinding method using a nanolayer-lubricated diamond grinding wheel based on a shock wave cavitation effect, wherein the method includes:

step S1. generating compressed gas and storing the compressed gas in a gas tank;

step S2. inputting the compressed gas into a gas acceleration tube, which has a push plate, a high pressure chamber and a low pressure chamber; inputting nanoparticles into the low pressure chamber and inputting compressed gas into the high pressure chamber, in which the compressed gas is further pressurized by the push plate until pressure of the compressed gas reaches a first preset threshold;

Step S3. Opening the high pressure chamber, so that the compressed gas is delivered to the low pressure chamber with a streamline tightening structure to push the nanoparticles therein to a second wave focusing device;

Step S4. setting two shock wave sources, a first shock wave source and a second shock wave source, which are both facing towards the grind wheel;

Step S5. generating shock waves in sequence with the two shock wave sources, wherein the first shock wave source generates first shock waves and enhance the first shock waves using a first wave focusing device in front of the first shock wave source, and the second shock wave source generates second shock waves and brings the nanoparticles in the second wave focusing device to impact the grind wheel;

Step S6. forming a uniformly distributed nanolayer on a grinding wheel surface by using the shock waves.

2. The grinding method of claim 1, wherein step S1 includes: turning on a gas pump to suck gas after a workpiece to be grinded is fixed at a workpiece fixing plate of a workbench, wherein the gas is compressed into a gas tank through a gas-guide tube, and when a gas pressure detector detects that gas pressure in the gas tank satisfies the first preset threshold, the gas pump is stopped, or else, the gas pump goes on working; and after the gas pump and the gas tank start to work, turning on a powder delivery switch, so that nanoparticles stored in a detachable sealed powder delivery box is delivered into the low-pressure chamber.

3. The grinding method of claim 2, wherein step S2 includes: turning on a gas pressure regulation valve, so that the compressed gas in the gas tank enters a movable chamber in said gas acceleration tube through a gas inlet tube, to push said push plate to compress the compressed gas in said high pressure chamber; and turning on a gas pressure sensing switch after sensing that a gas pressure of the high-pressure chamber satisfies a second preset threshold, so that the compressed gas in the high-pressure chamber enters the low-pressure chamber to generate a third shock wave.

4. The grinding method of claim 3, wherein step S3 includes: turning on a movable switch so that the generated third shock wave passes through a streamlined narrowing structure of the low-pressure chamber to form a pulse enhanced third shock wave to push the nanoparticles to move forward, and then the nanoparticles is further accelerated by a small de Laval nozzle, so that the nanoparticles acquire an initial velocity.

5. The grinding method of claim 4, wherein step S4 includes: connecting an electromagnetic coil to a bipolar high-pressure pulse current to enable the electromagnetic coil to generate a bidirectional electromagnetic force, to push an impact ball to start to reciprocate in a semicircular annular pipe, and to strike back and forth on the impact heads at two ends of the semicircular annular pipe at a high speed to generate high-frequency ballistic shock waves at each end, thus forming the two shock wave sources, the first shock wave source and the second shock wave source, wherein strength of the first shock waves is then improved under the action of the first wave focusing device and strength of the second shock waves is then improved under the action of the second wave focusing device; and when the impact ball strikes a first impact head and a second impact head at two ends of the semicircular annular pipe back and forth, making a heat sink start to operate.

6. The grinding method of claim 5, wherein step S5 includes: generating shock wave continually, wherein the first shock waves of the first shock wave source directly impact the grinding wheel surface to generate a cavitation effect to clean impurities on the grinding wheel surface, and also provides a condition for subsequent formation of a nanolayer; the second shock waves of the second shock wave source impact the nanoparticles with a high initial velocity, to provide the nanoparticles with a higher speed; and subsequent shock waves continuously increase speed of the nanoparticles, so that the nanoparticles are continuously accelerated downward in an axial direction of a large de Laval nozzle by using a Laval effect of the large de Laval nozzle, until the nanoparticles impact the grinding wheel surface at a maximum speed.

7. The grinding method of claim 1, wherein the grinding method uses the nanolayer-lubricated diamond grinding wheel with a metal binder layer thereon, wherein the metal binder is a bronze binder and the nanoparticles are metal nanoparticles.

8. The grinding method of claim 7, wherein the metal nanoparticles includes ferric oxide magnetic nanoparticles, with sizes ranging from 50 nm to 100 nm.

9. The grinding method of claim 1, wherein the compressed gas in the gas tank is air, and the first preset threshold ranges from 2.0 MPa to 8.0 MPa; and the structure of the gas acceleration tube is of a streamlined narrowing type to enhance the generated shock wave.

10. The grinding method of claim 9, wherein the nanoparticles impact the grinding wheel surface at a final speed ranging from 4200 m/s to 6800 m/s to form the nanolayer, wherein the thickness of the nanolayer ranges from 5 μm to 15 μm.

* * * * *